US007551143B2

(12) United States Patent
Park et al.

(10) Patent No.: US 7,551,143 B2
(45) Date of Patent: Jun. 23, 2009

(54) ANTENNA FEED LINE FOR PORTABLE TERMINAL

(75) Inventors: Jung-Min Park, Suwon-si (KR); Soon-Ho Hwang, Seoul (KR); Tae-Sik Yun, Suwon-si (KR); Kwang-Mo Yang, Suwon-si (KR); Nam-Ung Kim, Seoul (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 11/956,590

(22) Filed: Dec. 14, 2007

(65) Prior Publication Data

US 2008/0143615 A1 Jun. 19, 2008

(30) Foreign Application Priority Data

Dec. 14, 2006 (KR) ..... 10-2006-0127696

(51) Int. Cl.
*H01Q 1/24* (2006.01)

(52) U.S. Cl. ..... 343/702; 343/841; 343/850

(58) Field of Classification Search ..... 343/702, 343/841, 850, 851
See application file for complete search history.

(56) References Cited

U.S. PATENT DOCUMENTS 7,196,273 B2 * 3/2007 Tanaka et al. ..... 174/117 R

FOREIGN PATENT DOCUMENTS

JP 2003-188609 7/2003
KR 1020060058585 5/2006

* cited by examiner

*Primary Examiner*—Anh Q Tran
(74) *Attorney, Agent, or Firm*—The Farrell Law Firm, LLP

(57) ABSTRACT

An antenna feed line for a portable terminal is provided that includes first films in which shielding lines are formed lengthwise and a second film disposed between the first films and having at least one pair of signal lines formed lengthwise. The antenna feed line is a flexible printed circuit having a layered structure of the first films and the second film, while the signal lines are shielded by the shielding lines. Use of the antenna feed line allows a stable connection to be maintained in spite of external shock, and signal loss during transmission/reception can be reduced. Moreover, the antenna feed line can be easily fixed inside the portable terminal.

8 Claims, 3 Drawing Sheets

ANTENNA FEED LINE FOR PORTABLE TERMINAL

PRIORITY

This application claims the priority under 35 U.S.C. §119 (a) to a Korean Patent Application filed in the Korean Intellectual Property Office on Dec. 14, 2006 and assigned Ser. No. 2006-127696, the entire disclosure of which is incorporated herein by reference.

BACKGROUND OF THE INVENTION

1. Field of the Invention

The present invention generally relates to an antenna for a portable terminal, and, in particular, to an antenna feed line for a portable terminal.

2. Description of the Related Art

Generally, a "portable terminal" refers to a mobile communication device which enables wireless communications between users or between a user and a service provider through a base station. Applications such as voice communication or Short Message Service (SMS) have been provided to users using portable terminals at the early stages of a mobile communication service, but such services now extend to video communication, moving picture services, mobile banking, and the like as communication technology develops. An antenna is essential for communication with another user via a base station. Moreover, as the mobile communication service extends to a multimedia service such as a moving picture service, the performance of an antenna has become an important barometer of signal quality of the portable terminal.

A conventional antenna generally protrudes outward from the portable terminal. As a result, the antenna is likely to be damaged by external shock or is inconvenient to carry and limits the diversification of the design of the portable terminal. Moreover, recent users have demanded a small portable terminal having an elegant appearance.

Thus, an attempt to install the antenna inside the portable terminal has been made, and most portable terminals now have a built-in antenna. However, there are many difficulties in securing an antenna mounting space inside the portable terminal, and the built-in antenna has a lower electric wave reception sensitivity than a protruding antenna.

For stable operation of the built-in antenna, the antenna is disposed in a lower portion of the portable terminal, and a main board is disposed in an upper portion of the portable terminal, thereby avoiding interference between the antenna and the main board. In addition, a Radio Frequency (RF) cable as a coaxial cable is generally installed to connect an RF end of the main board with a feeder of the antenna.

However, connectors are installed at both ends of the conventional RF cable so that the RF cable can be connected with the main board and the antenna. The connectors may be separated from the RF end or the feeder by external shock applied to the portable terminal, causing an interruption in the stable connection between the antenna and the main board. Furthermore, the conventional RF cable is used to transmit/receive a signal without being completely shielded, resulting in signal loss during signal transmission/reception. Moreover, the RF cable is the conventional axial cable type that is inconvenient to fix inside the portable terminal due to the space requirements of the RF cable.

SUMMARY OF THE INVENTION

An aspect of the present invention is to address at least the above problems and/or disadvantages and to provide at least the advantages described below. Accordingly, an aspect of the present invention is to provide an antenna feed line for a portable terminal, which maintains a stable connection between a main board and an antenna in spite of external shock.

Another aspect of the present invention is to provide an antenna feed line for a portable terminal, which reduces signal loss during signal transmission/reception.

Another aspect of the present invention is to provide an antenna feed line for a portable terminal, which is easy to fix in the portable terminal.

According to one aspect of the present invention, there is provided an antenna feed line for a portable terminal. The antenna feed line includes first films in which shielding lines are formed lengthwise and a second film disposed between the first films and having at least one pair of signal lines formed lengthwise. The antenna feed line is a flexible printed circuit having a layered structure of the first films and the second film while the signal lines are shielded by the shielding lines.

BRIEF DESCRIPTION OF THE DRAWINGS

The above and other features and advantages of an exemplary embodiment of the present invention will be more apparent from the following detailed description taken in conjunction with the accompanying drawings, in which.

DETAILED DESCRIPTION OF THE PREFERRED EMBODIMENTS

The matters defined in the description such as a detailed construction and elements are provided to assist in a comprehensive understanding of an exemplary embodiment of the invention. Accordingly, those of ordinary skill in the art will recognize that various changes and modifications of the embodiment described herein can be made without departing from the scope and spirit of the invention. Also, descriptions of well-known functions and constructions are omitted for clarity and conciseness.

Figure 1:
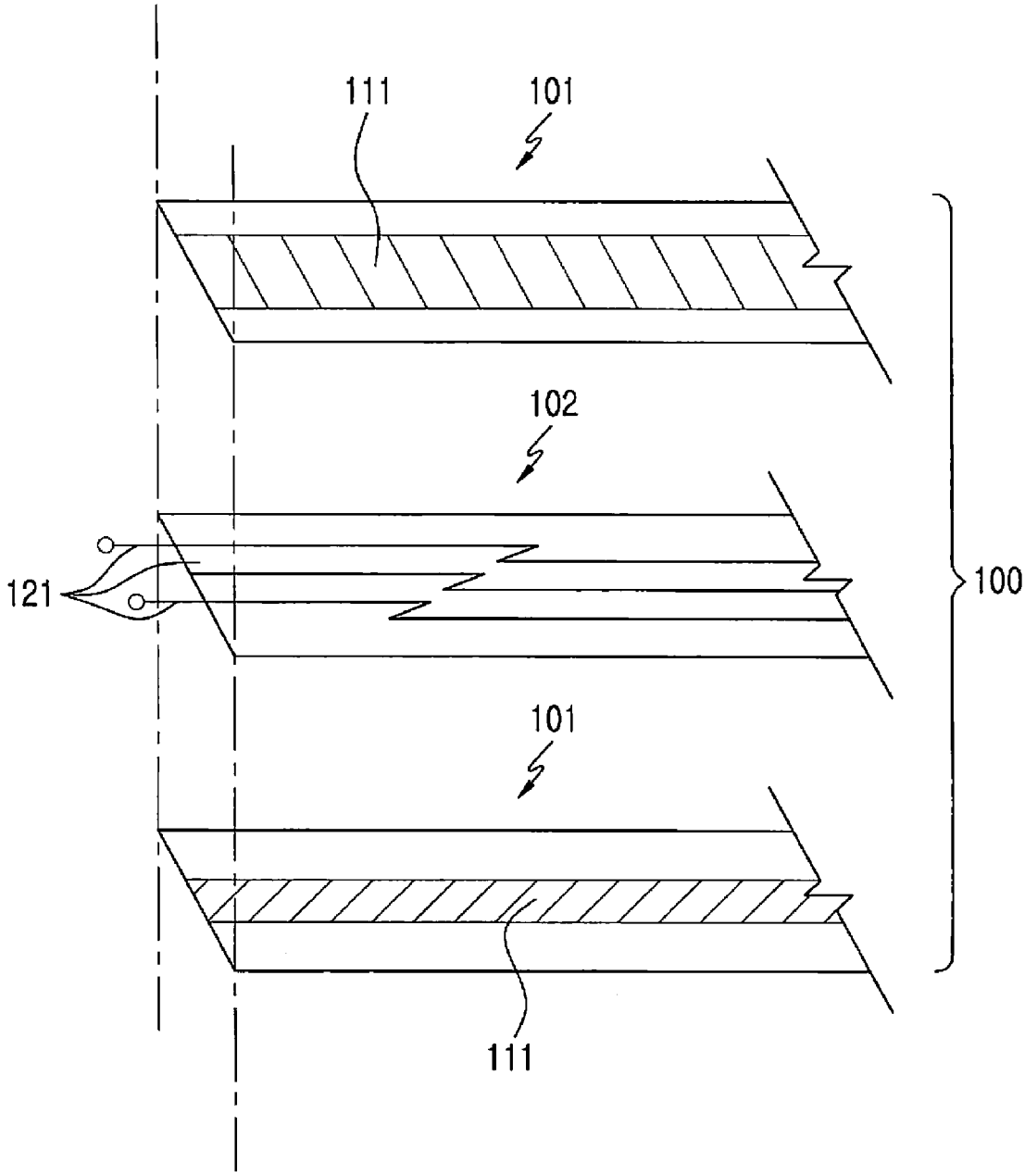
FIG. 1 illustrates the structure of an antenna feed line for a portable terminal according to an exemplary embodiment of the present invention.

FIG. 1 illustrates the structure of an antenna feed line 100 for a portable terminal according to an exemplary embodiment of the present invention. Referring to FIG. 1, the antenna feed line 100 includes a flexible printed circuit having first films 101 and a second film 102.

The first films 101 include lengthwise shielding lines 111. The shielding lines 111 serve as a ground having low electric potential. The first films 101 are provided as a pair, and the shielding lines 111 face each other.

The second film 102 includes at least one pair of signal lines 121 extending in the lengthwise direction. The second film 102 is disposed between the first films 101, and the signal lines 121 are shielded by being surrounded by the shielding lines 111. The signal lines 121 may provide feeding and grounding.

In a preferred embodiment of the present invention, the antenna feed line 100 is formed of a three-layered structure of the first film 101, the second film 102, and an other first film 101 sequentially deposited. When the first films 101 and the second film 102 are deposited, the signal lines 121 are surrounded by the shielding lines 111, and both ends of each of the signal line 121 used for feeding (the feeding signal line) or the signal line 121 used for grounding (the grounding signal line) protrude from ends of the shielding lines 111. That is, the antenna feed line 100 is a flexible printed circuit having a three-layered structure, and both ends of each of the signal lines 121 protrude from ends of the shielding lines 111.

Figure 2:
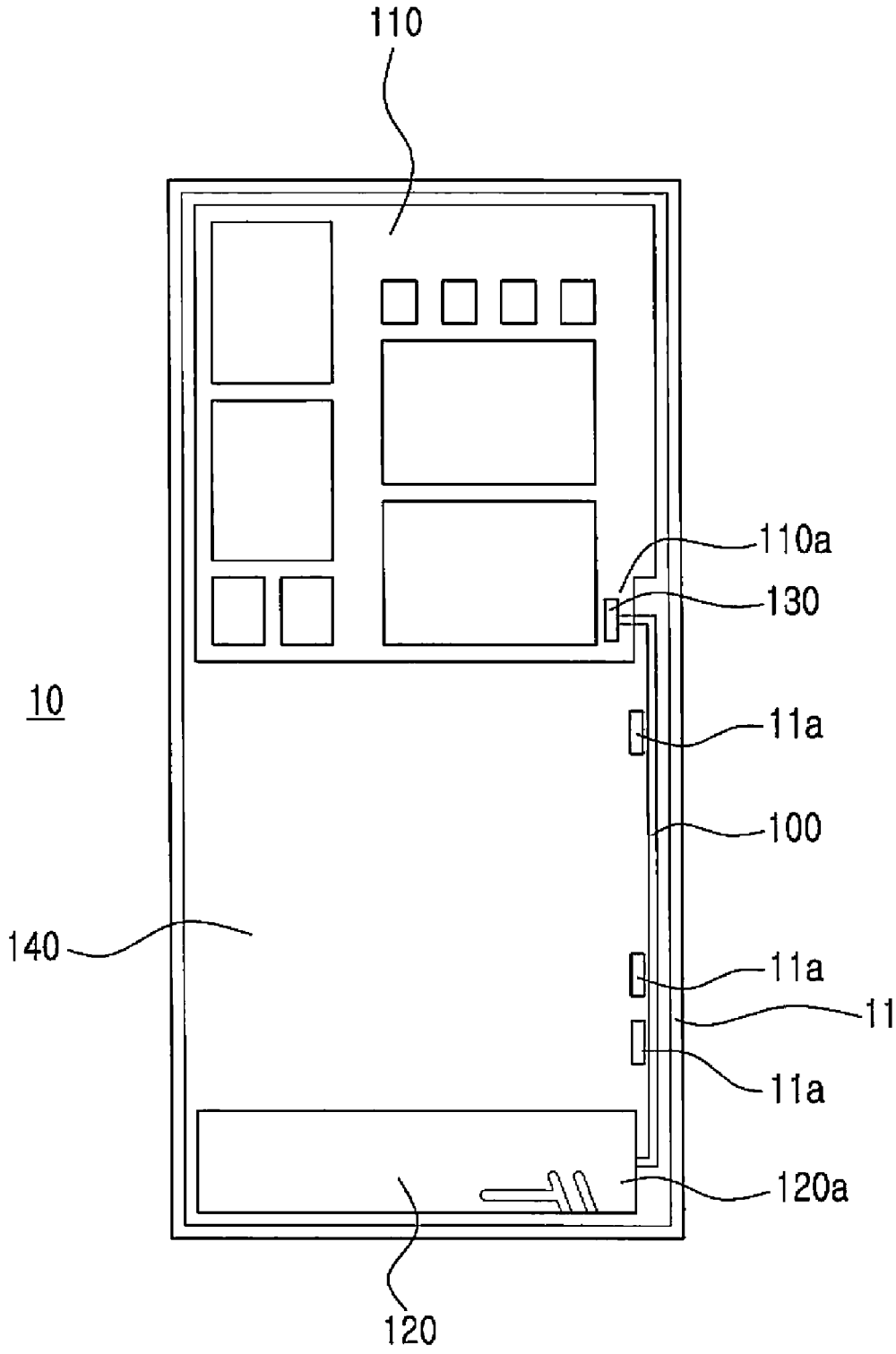
FIG. 2 is a plan view showing the inside of a portable terminal having the antenna feed line illustrated in FIG. 1.
Figure 3:
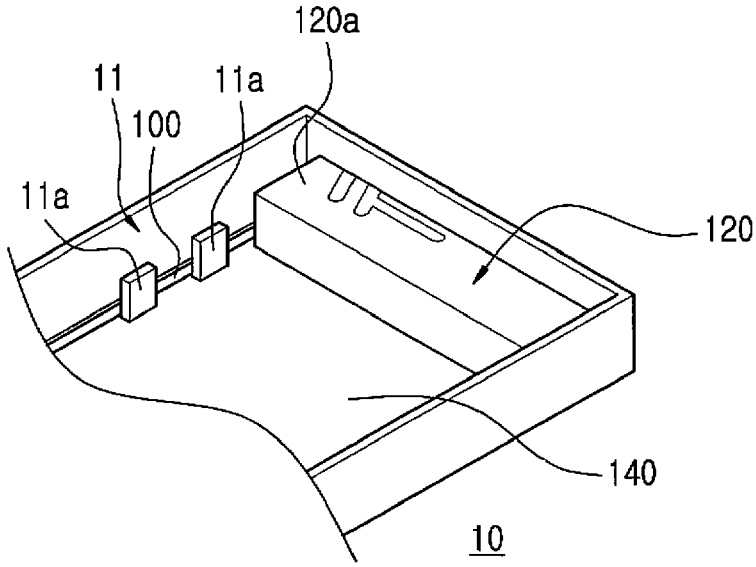
FIG. 3 is a perspective view showing a state in which the antenna feed line illustrated in FIG. 1 is connected with an antenna of the portable terminal.
Figure 4:
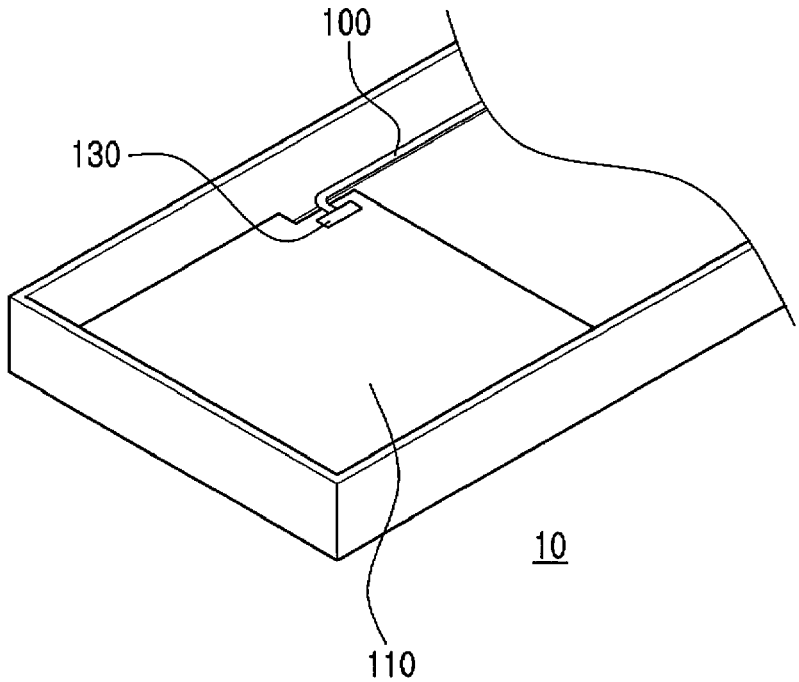
FIG. 4 is a perspective view showing a state in which the antenna feed line illustrated in FIG. 1 is connected with a main board of the portable terminal.

FIG. 2 is a plan view showing the inside of a portable terminal 10 having the antenna feed line 100 illustrated in FIG. 1, FIG. 3 is a perspective view showing a state in which the antenna feed line 100 illustrated in FIG. 1 is connected with an antenna 120 of the portable terminal 10, and FIG. 4 is a perspective view showing a state in which the antenna feed line 100 illustrated in FIG. 1 is connected with a main board 110 of the portable terminal 10. As illustrated in FIGS. 2 through 4, the main board 110 and the antenna 120 are disposed inside the portable terminal 10, and the main board 110 and the antenna 120 are connected by the antenna feed line 100.

The main board 110 is disposed in an upper portion of the portable terminal 10 and components for processing a signal generated by the portable terminal 10, processing a received signal, and controlling the portable terminal 10 are installed in the main board 110. A Radio Frequency (RF) end 110*a* is formed in a lower portion of the main board 110. The RF end 110*a* converts and controls a signal generated from the portable terminal 10 into a signal suitable for transmission to a partner or a signal provided from a partner into a signal suitable for use in the portable terminal 10.

The antenna 120 is disposed in a lower portion of the portable terminal 10 while being spaced apart from the main board 110. A feeding end 120*a* is formed in one end portion of the antenna 120. The feeding end 120*a* is provided with a signal from the RF end 110*a* to operate the antenna 120. The antenna 120 transmits a signal provided from the RF end 110*a* or receives an electric wave from outside the terminal 10.

The antenna feed line 100 is disposed lengthwise of the portable terminal 10 in order to connect the main board 110 with the antenna 120. More specifically, both ends of the feeding signal line 121 are connected to the RF end 110*a* of the main board 110 and the feeding end 120*a* of the antenna 120, and the grounding signal line 121 is connected to a grounding unit (not shown) of the portable terminal 10. The signal lines 121 are connected and fixed to the main board 110 and the antenna 120 by a connector 130. The connector 130 is in one embodiment an insulating tape. Soldering may also be utilized for the connector 130. Thus, ends of the signal lines 121 can maintain a stable connection with the RF end 110*a* and the feeding end 120*a* without being separated from the RF end 110*a* and the feed line 120*a*, even when external shock is applied to the portable terminal 10.

Supports 11*a* spaced apart from a side of the portable terminal 10 and protruding on the inner circumferential face of the portable terminal 10 are formed inside the portable terminal 10. A mounting unit 11 is formed by the supports 11*a* in the portable terminal 10. The mounting unit 11 provides a space between an inner side face of the portable terminal 10 and the supports 11*a*. The antenna feed line 100 is fixed and supported in the mounting unit 11. A settling surface 140 is formed between the main board 110 and the antenna 120. The settling surface 140 is adjacent to the mounting unit 11, and a battery (not shown) is disposed in the settling surface 140.

The main board 110 and the antenna 120 operate through the antenna feed line 100 as follows.

The portable terminal 10 performs voice communication, short message transmission, content downloading, or the like through transmission/reception via the antenna 120. A signal generated in the main board 110 is converted by the RF end 110*a* and transmitted to the antenna 120, specifically the feeding end 120*a*, through the feeding signal line 121. The signal arriving at the feeding end 120*a* is transmitted via the antenna 120.

The signal received via the antenna 120, specifically via the feeding end 120*a*, arrives at the RF end 110*a* through the feeding signal line 121 using the feeding end 120*a*. The signal arriving at the RF end 110*a* is converted into a signal suitable for processing and control in the main board 110. Thus, the signal converted by the RF end 110*a* is processed and controlled in the main board 110 and is output by the portable terminal 10 in the form of voice, text and/or image.

The antenna 120 is connected to the main board 110 by the antenna feed line 100 to receive a signal from outside or to transmit a signal to outside.

Generally, to measure the transmission/reception performance of the portable terminal 10, a Total Radiated Power (TRP) and a Total Isotropic Sensitivity (TIS) are measured. The TRP is defined as a sum of all powers that are actually radiated by the antenna 120 irrespective of direction or polarity and indicates the transmission performance of the portable terminal 10. The TIS is defined as an average power that can be acquired by the antenna 120 from outside and indicates the reception performance of the portable terminal 10. The feeding signal line 121 is shielded by the shielding lines 111, thereby reducing loss during signal transmission. Thus, the portable terminal 10 having the antenna feed line 100 reduces the loss of the TRP and the TIS, thereby improving radiation performance. Moreover, the width of the feeding signal line 121 can be adjusted according to the frequency of a signal transmitted on the first films 101 and the second film 102. Therefore, signal transmission through the feeding signal line 121 provides the same effect as in the case of signal transmission in a printed circuit board, thereby reducing signal loss.

As described above, an antenna feed line for a portable terminal according to the present invention is a flexible printed circuit including first films having shielding lines formed lengthwise and a second film having signal lines formed lengthwise between the first films. Both ends of each of the signal lines are exposed while the signal lines are shielded by the shielding lines. At this time, the signal lines are connected and fixed to the main board and the antenna by means of soldering or an insulating tape, thereby maintaining a stable connection with the main board and the antenna despite external shock. Moreover, the signal lines are shielded by the shielding lines, thus being protected from external noise. Therefore, it is possible to prevent a signal traveling through the signal lines from being distorted or lost by external noise. The antenna feed line can be easily fixed in the portable terminal, using the superior in curvation of a flexible printed circuit.

While the invention has been shown and described with reference to an exemplary embodiment thereof, it will be understood by those skilled in the art that various changes in form and details may be made therein without departing from the spirit and scope of the invention.

What is claimed is:

1. An antenna feed line for a portable terminal, the antenna feed line comprising:

first films in which shielding lines are formed lengthwise; and a second film disposed between the first films and having at least one pair of signal lines formed lengthwise, wherein the antenna feed line is a flexible printed circuit having a layered structure of the first films and the second film while the signal lines are shielded by the shielding lines.

2. The antenna feed line of claim 1, wherein one of the signal lines provides feeding and the other provides grounding.

3. The antenna feed line of claim 2, wherein both ends of each of the signal lines protrude from ends of the shielding lines.

4. A portable terminal comprising:

a main board disposed inside the portable terminal;

an antenna spaced apart from the main board and disposed inside the portable terminal; and an antenna feed line, the antenna feed line comprising:

first films in which shielding lines are formed lengthwise; and a second film disposed between the first films and having at least one pair of signal lines formed lengthwise, wherein the antenna feed line is a flexible printed circuit having a layered structure of the first films and the second film while the signal lines are shielded by the shielding lines, wherein one of the signal lines provides feeding and the other provides grounding, and wherein one end of the signal line that provides feeding is connected with a Radio Frequency (RF) end of the main board, an other end is connected with a feeding end of the antenna, and one end of the signal line that provides grounding is connected with a grounding unit provided in the portable terminal.

5. The portable terminal of claim 4, wherein the signal lines are connected with and fixed to the RF end of the main board, the feeding end of the antenna, and the grounding unit of the portable terminal by soldering.

6. The antenna feed line of claim 1, wherein the signal lines are disposed between the shielding lines, and are surrounded by the shielding lines.

7. The antenna feed line of claim 1, wherein the portable terminal further includes a mounting unit, and the flexible printed circuit is mounted and supported in the mounting unit.

8. The antenna feed line of claim 3, wherein a space is provided between the main board and the antenna to dispose a battery.

* * * * *